US005214321A

United States Patent [19]

Curtis

[11] Patent Number: 5,214,321

[45] Date of Patent: May 25, 1993

[54] ANALOG MULTIPLIER/DIVIDER UTILIZING SUBSTRATE BIPOLAR TRANSISTORS

[76] Inventor: Douglas R. Curtis, 110 Highland Ave., Los Gatos, Calif. 95032

[21] Appl. No.: 858,092

[22] Filed: Mar. 26, 1992

[51] Int. Cl.[5] ..... G06G 7/16; G06G 7/00

[52] U.S. Cl. ..... 307/529; 307/494; 307/498; 328/158

[58] Field of Search ..... 307/529, 494, 498; 328/26, 158, 160, 161

[56] References Cited

U.S. PATENT DOCUMENTS

| | | | |
|---|---|---|---|
| 3,662,187 | 5/1972 | Ayres et al. | 328/160 |
| 3,805,092 | 4/1974 | Henson | 307/498 |
| 4,572,975 | 2/1986 | Bowers | 328/160 |
| 4,577,119 | 3/1986 | Kim et al. | 307/494 |
| 4,599,572 | 7/1986 | Nakayama | 307/498 |
| 5,151,624 | 9/1992 | Stegherr et al. | 328/160 |

*Primary Examiner*—William L. Sikes
*Assistant Examiner*—Toan Tran
*Attorney, Agent, or Firm*—Keith Kline

[57] ABSTRACT

An analog multiplier/divider circuit comprising in basic form four bipolar transistors with all collectors in common and a high gain differential input amplifier controlling an output transfer means. All input signals and the output signal are applied as currents to the emitters of the four transistors. The emitters, as opposed to the collectors, are monitored and sensed by the amplifier. The four transistors are arranged such that the base-emitter voltage of the third transistor, the value of which is proportional to the logarithm of a third input current applied to its emitter, is added to the base-emitter voltage of the fourth transistor, the value which is proportional to the logarithm of the output current applied to the fourth transistor's emitter. The sum of the two voltages is forced by the amplifier to be equal to the sum of the base-emitter voltage of the first transistor, the value which is proportional to the logarithm of a first input current applied to its emitter, and the base-emitter voltage of the second transistor, the value of which is proportional to a second input current applied to the second transistor's emitter. The amplifier forces the first sum equal to the second sum by comparing the two sums at its inputs and regulating the output current until the amplifier inputs are equal.

26 Claims, 3 Drawing Sheets

ANALOG MULTIPLIER/DIVIDER UTILIZING SUBSTRATE BIPOLAR TRANSISTORS

BACKGROUND OF THE INVENTION

The present invention relates in general to analog multiplier/divider circuits, and more particularly those utilizing the logarithmic V-I characteristic of substrate bipolar transistors easily fabricated in standard CMOS processes.

The use of the highly predictable logarithmic-antilogarithmic properties of bipolar diodes and transistors to form analog computational circuits which perform multiplication, division, exponents, and other mathematical functions is well known in the field of analog electronics. An excellent summary of such techniques can be found in "The Non-Linear Circuits Handbook" published by Analog Devices, 1974. These techniques are also the basis of numerous issued patents including:

G. E. Platzer, U.S. Pat. No. 3,152,250, issued Oct. 6, 1964

D. E. Blackmer, U.S. Pat. No. 3,714,462, issued Jan. 30, 1973

H. K. Henson, U.S. Pat. No. 3,805,092, issued Apr. 16, 1974

D. R. Curtis, U.S. Pat. No. 4,004,141, issued Jan. 18, 1977

Most of the teachings of the patents in the prior art are well suited to being embodied in a single monolithic integrated circuit utilizing standard bipolar processes, as demonstrated by the numerous commercially available analog computation integrated circuit products (ICs) such as the AD536, AD538, AD636, and AD637 manufactured by Analog Devices, Inc., and others.

In recent years CMOS processes which allow the fabrication of MOS transistors on a single substrate have emerged as a dominant technology especially for digital logic circuits, because of its generally higher density and lower power consumption than that obtainable with bipolar IC processes. CMOS processes are also well suited for implementing analog circuits, making them popular for integrating large electronic systems containing both digital logic and analog functions into a single piece of semiconductor material, a feature not practical with bipolar processes. Much research has been done recently to implement analog computational circuits utilizing MOS transistors instead of bipolar transistors to allow the inclusion of such circuits in integrated CMOS digital/analog systems, and several patents have been issued disclosing several of these techniques, including: U.S. Pat. No. 3,956,643, U.S. Pat. No. 4,906,873, and U.S. Pat. No. 4,978,873.

Although such CMOS implementations have been successful, the resulting computational circuits still do not provide the dynamic range or accuracy obtainable from their bipolar counterparts. Moreover, in most circuit configurations utilizing bipolar transistors, device mismatches generally produce only a gain or scale factor error. Such errors are easily trimmed out or adjusted for elsewhere in the system in bipolar applications. In MOS configurations, device mismatches generally produce both linearity and gain errors, the former being much more difficult to correct or accommodate.

Hence, implementing analog computational circuits with bipolar transistors in most cases is still preferred. The preference accounts for the occurrence of many two-IC solutions found in the market, an example of which is digital multimeters capable of measuring the RMS value of an AC voltage. One IC is fabricated in a CMOS process and contains all of the digital circuits and majority of analog circuits; the other IC, fabricated in a bipolar process, contains an analog multiplier/divider configured as an RMS-to-DC converter. It would be highly desirable to integrate the RMS-to-DC converter with the remaining voltmeter circuitry into a single IC without suffering reduced RMS conversion performance.

Two possible solutions remain. One possible solution is to utilize a more advanced process, generally called BiCMOS, which allows the fabrication of both isolated bipolar transistors and MOS transistors on a single substrate. However, such processes presently can require nearly twice as many processing steps or more than a standard CMOS process, resulting in a significantly higher cost to manufacture an IC fabricated by such a process.

The other possible solution entails utilizing the substrate bipolar parasitic transistor inherent in even the simplest of CMOS processes. Such a transistor is considered parasitic because it is not intentionally fabricated, but instead results as a normally undesirable component of the fabricated MOS transistor.

An important characteristic of these parasitic bipolar transistors is that their collectors and the substrate are one and the same. That is, the collectors are all common, and the currents flowing through one collector cannot be distinguished from the current flowing through the collector of another transistor fabricated on the same piece of semiconductor material. All such collector currents are summed internal to the substrate and appear in combination at any electrode connected anywhere to the substrate. Hence, these parasitic transistors are also referred to as substrate bipolar transistors, and have very limited applications.

In particular, they may not be used in any of the computational circuits found in the prior art. In all applications using prior art circuits at least one and typically all collectors must be separate and independent of each other. This separation is required because in all prior art circuits, the collector is the primary electrode which is monitored by the circuitry either for the purpose of forcing the collector currents to substantially equal an input signal, or for the purpose of extracting the desired output signal. Thus, none of the prior art circuit topologies may be employed when the collectors of all bipolar transistors are in common, as is the case for the substrate bipolar available in standard CMOS processes.

OBJECT OF THE INVENTION

Accordingly, it is a principle object of the present invention to provide an analog multiplier/divider circuit which utilizes the logarithmic characteristics of substrate bipolar transistors inherent in standard CMOS processes.

Another object of the present invention is to provide an analog multiplier/divider circuit that provides high accuracy and wide dynamic range, and where device mismatches and other sources of error cause only gain error.

Another object of the present invention is to provide an analog multiplier/divider circuit that may be fabricated on the same substrate with other digital logic and analog circuits at low manufacturing cost.

Yet another object of the present invention is to provide an analog multiplier/divider circuit that may be easily configured to form an RMS-to-DC Converter.

These and other objects and advantages of the present invention will become apparent to those skilled in the art in view of the description of the best presently known mode of carrying out the invention as described herein and as illustrated in the drawings.

SUMMARY OF THE INVENTION

To accomplish the foregoing and other objects of the invention, the electronic circuit of the present invention comprises in basic form four bipolar transistors with all collectors connected in common and a high gain differential input amplifier controlling an output transfer means. All input signals and the output signal are applied as currents to the emitters of the four transistors. The emitters, as opposed to the collectors, are monitored and sensed by the amplifier.

The four transistors are arranged such that the base-emitter voltage of the third transistor, the value of which is proportional to the logarithm of a third input current applied to its emitter, is added to the base-emitter voltage of the fourth transistor, the value which is proportional to the logarithm of the output current applied to the fourth transistor's emitter. The sum of the two voltages is forced by the amplifier to be equal to the sum of the base-emitter voltage of the first transistor, the value which is proportional to the logarithm of a first input current applied to its emitter, and the base-emitter voltage of the second transistor, the value of which is proportional to a second input current applied to the second transistor's emitter. The amplifier forces the first sum equal to the second sum by comparing the two sums at its inputs and regulating the output current until the amplifier inputs are equal.

Putting the configuration of the circuit in terms of an equation yields:

$$V_{T3}ln(I_3/I_{S3})+V_{TO}ln(I_O/I_{SO})=V_{T1}ln(I_1/I_{S1})+V_{T2}ln(I_2/I_{S2}) \quad \text{(Equation 1)}$$

Where VT is the thermal voltage equal to KT/q for each junction; $I_1$, $I_2$, and $I_3$ are the input currents; $I_O$ is the output current; and $I_{S1}$, $I_{S2}$, $I_{S3}$ and $I_{SO}$ are the reverse saturation currents of the respective base emitter junctions.

When all transistors are fabricated on a single substrate allowing all junctions to be substantially at the same temperature and hence all VT's to be identical, the above equation reduces to:

$$I_O=((I_{SO}\times I_{S3})/(I_{S1}\times I_{S2}))\times((I_1\times I_2)/I_3) \quad \text{(Equation 2)}$$

Equation 2 shows that the output current is proportional to the product of the first and second input currents and quotient of the third input current.

Since the ratios of the four reverse saturation currents are proportional to the respective ratios of the corresponding emitter areas, the first term, or factor of proportionality, is constant. If all emitters are of equal area, as is typically the case for best matching, then the first term is unity as all reverse saturation currents are equal. However, other proportionality factors may be utilized simply by taking the ratio of the emitter areas. Thus, the above described configuration performs the function of multiplier/divider.

A very important aspect of the above described configuration is that only the base and emitter electrodes of the four transistors are employed, and no use or consideration is made of the currents generated in the collectors of these transistors. This feature thus allows these collectors to not only be connected in common, i.e. to s single element, but also to be made part of a common substrate, which may in addition contain thousands of other integrated components and yet have no effect upon the performance of the multiplier/divider circuit. This feature is the principle advantage which allows the present invention to be employed even in the simplest and most inexpensive CMOS process.

Fundamental to any CMOS process is the incorporation of an isolation tub, also known as a well, in the substrate whose semiconductor material polarity is of opposite type to that of the substrate. This well allows a MOS transistor be formed inside the well which has opposite polarity conductivity to the MOS transistor formed directly in the substrate, thus allowing complementary devices to co-exist, the primary feature of all CMOS processes.

It is this well which also forms the base of the substrate bipolar, where the substrate, being of opposite polarity semiconductor type to the well, forms the collector, and where the MOS transistor drain/source diffusion inside the well, also being of opposite polarity semiconductor type to the well, forms the emitter. For a n-type substrate, the well is p-type and the substrate bipolar is NPN. Conversely, for a p-type substrate, the well is n-type and the substrate bipolar is a PNP. Use of either type is within the scope of the present invention.

Such a substrate bipolar transistor may be fabricated not only as part of the MOS transistor inside the well, but also as a separate device with no associated MOS transistor, simply by forming a single drain/source diffusion inside the well without the MOS transistor gate and second drain/source diffusion. Such a structure can then be optimized for bipolar performance with minimized bulk base resistance and bulk emitter resistance. In typical CMOS processes, high current gains and good log conformity from several nanoamperes up to several hundred microamperes are easily achievable. Such bipolar devices can be fabricated even in the most basic CMOS process utilizing a minimum number of processing steps, whether the process is metal gate or silicon gate, and without adding any extra processing steps, and hence cost, to form the bipolar. It should be noted that, although intended for implementation in CMOS processes, the present invention is not limited to that particular process, and may be incorporated into any process capable of forming bipolar transistors.

DETAILED DESCRIPTION OF THE PREFERRED EMBODIMENTS

Figure 1:
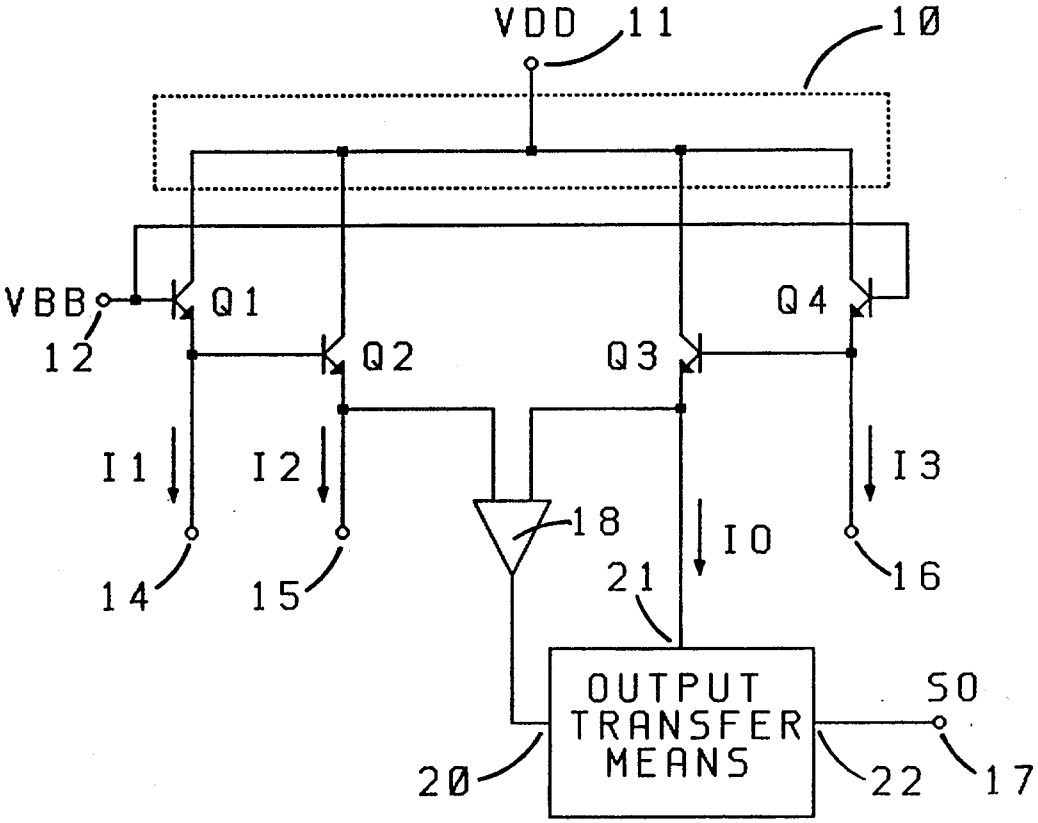
FIG. 1 is a general schematic block diagram of the circuit of the present invention in its most fundamental form.

Referring now to the drawings and in particular to FIG. 1, there is shown a general block diagram of the circuit of the present invention in its most fundamental form. The circuit includes four bipolar transistors Q1, Q2, Q3, and Q4 which all have their collectors connected together in common and supplied by a single voltage, $V_{DD}$, applied to terminal 11. The dashed box 10 indicates that all four collectors could actually be a single piece of semiconductor material, such as the substrate of an integrated circuit. The bipolar transistors in FIG. 1 as well as the remaining figures are shown as NPN types but also could be PNP types operating with no difference other than a polarity reversal in all operating voltages and currents.

The emitter of Q1 connects to the base of Q2, while the emitter of Q3 connects to the base of Q4. The base of Q1 and Q3 are both supplied by a constant bias voltage $V_{BB}$ applied to terminal 12, which generally is the same or lower in value than $V_{DD}$. The emitter of Q2 is connected to one input of a differential input amplifier 18 having high gain and low input offset while the emitter of Q4 is connected to the other input of amplifier 18. The output of amplifier 18 drives a control port 20 of an output transfer means 19 which generates at least two outputs, a current $I_O$ at output port 21 which supplies the emitter of Q4, and an output signal $S_O$ at output port 22 which connects to output terminal 17.

The two or more outputs of the output transfer means 19 are related in some manner, typically by a constant factor of direct proportionality with a high degree of linearity. Although useful circuit operation is possible with only two output ports, additional outputs from the output transfer means related to $I_O$ can provide easier and more flexible interfacing to succeeding circuitry. The output signal appearing at port 22 and terminal 17 could be either a current or voltage. Hence, the basic function of the output transfer means is to transfer the information contained in the emitter current $I_O$ of Q4 to an outside terminal or terminals which can be accessed by other circuits.

First, second, and third input signals are applied as currents to input terminals 14, 15, and 16 respectively, which supply these input currents to the emitters of Q1, Q2, and Q3 respectively. As these input currents flow through their respective base-emitter junctions and into their respective collectors, they generate base-emitter voltage drops $V_{BE1}$, $V_{BE2}$, and $V_{BE3}$ respectively.

Similarly, the output current $I_O$ from output transfer means 19 flowing through the base-emitter junction of Q4 generates base-emitter voltage drop $V_{BE4}$. High gain differential input amplifier 18 operates in a closed loop with output transfer means 19 and regulates output current $I_O$ and consequently output signal $S_O$ to a level which causes the two inputs of amplifier 18, and consequently the values at the emitters of Q2 and Q4, to be substantially equal, typically within less than 1 mV. Hence, the base emitter voltage drops of all four transistors become related as follows:

$$V_{BB}-V_{BE1}-V_{BE2}=V_{BB}-V_{BE3}-V_{BE4} \quad \text{(Equation 3)}$$

or, $$V_{BE1}+V_{BE2}=V_{BE3}+V_{BE4} \quad \text{(Equation 4)}$$

As is well known in electronics, the base-emitter voltage of a bipolar transistor is proportional to the natural logarithm of the current flowing through the base-emitter junction over a wide current range with a high degree of accuracy according to the following:

$$V_{BE}=V_T \ln(I_E/I_S) \quad \text{(Equation 5)}$$

Where $V_T$ and $I_S$ are as defined previously and $I_E$ is the emitter current flowing through the base-emitter junction.

Neglecting base currents, the errors caused by which are typically small, and substituting into Equation 4 the base-emitter voltage drop vs. emitter current equivalents for each junction as defined in Equation 5 yields Equation 1. If the output signal $S_O$ of the output transfer means 19 is directly proportional output current $I_O$ as previously suggested, then output signal $S_O$ also will be directly proportional to the product of input currents $I_1$ and $I_2$ and quotient of input current $I_3$.

In cases where the base currents could cause significant error, identical buffers having high input impedance and unity voltage gain could be added between the emitter of Q1 and the base of Q2 and between the emitter of Q3 and the base of Q4. Such a buffer could be as simple as a substrate bipolar transistor used as an emitter follower biased by a constant current source.

In FIG. 1 as well as in the remaining figures, one of the current outputs of the output transfer means 19 supplies the emitter of Q4 while one of the three input signals supplies the emitter of Q3. It should be noted that the reverse connections could be made, where output current $I_O$ supplies the emitter of Q3 while input current $I_3$ supplies the emitter of Q4, without affecting the basic operation of these circuits. Such alternate connections are still therefore in accordance with the principles of the present invention.

Major sources of error, other than that from basic logarithmic conformity of the transistors and from the output transfer means, are the mismatch between transistors and input offset of the differential amplifier. Transistor mismatches simply result in differences in the reverse saturation currents of each transistor which, as demonstrated by Equation 2, will only cause an error in the factor of proportionality or gain of the transfer function. Differential amplifier input offset, $V_{OS}$, will cause $V_{BE1}+V_{BE2}$ to differ from $V_{BE3}+V_{BE4}$ by the amount of $V_{OS}$. Using the same mathematical manipulation as before will again result in Equation 2 but with an additional factor of proportionality as follows:

$$I_O=((I_{SO}\times I_{S3})/(I_{S1}\times I_{S2}))\times e^{(VOS/VT)}\times((I_1\times I_2)/I_3) \quad \text{(Equation 6)}$$

As $V_{OS}$ is generally constant for high gain amplifiers, this additional gain factor will also be constant except for a small temperature dependence. Hence, both of these sources of error do not affect linearity, but only gain which can be easily eliminated by manual or automatic adjustment. Some adjustment techniques are suggested in the remaining descriptions.

It will be noted in FIG. 1 that the customary polarity signs assigned to the inputs of the differential amplifier 18 have been purposely omitted, as they depend on the actual implementation of output transfer means 19.

Figure 2:
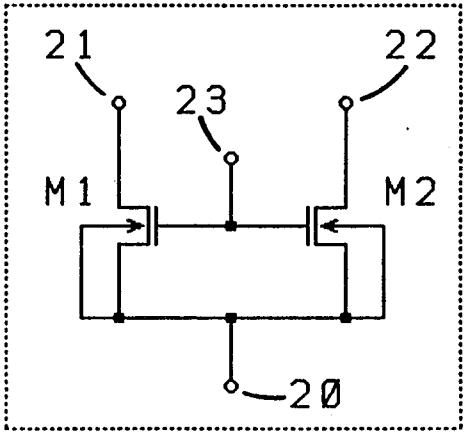
FIG. 2 is a schematic diagram depicting one simple embodiment of the output transfer means of FIG. 1.

Referring now to FIG. 2 there is shown a circuit diagram of one embodiment of the output transfer means in a simplified form. This transfer means includes two MOS transistors, M1 and M2, whose sizes and transconductances are made equal. An appropriate constant bias voltage is applied to terminal 23 and thereby to the gates of M1 and M2. The output of the differential amplifier is connected to terminal 20 thereby driving the sources of M1 and M2 which causes substantially equal currents to flow into terminal 21 and terminal 22 by virtue of equal gate-source voltages.

Thus, output signal $S_O$ in FIG. 1 is a current with the same direction and magnitude as current $I_O$, accurately representing the emitter current through Q4, and effectively allowing its transfer to an outside terminal. This output current $S_O$, can be used directly to supply succeeding circuitry, or converted to a voltage simply with a resistor between terminal 22 and an appropriate bias voltage or supply terminal.

The embodiment of the present invention in FIG. 1 may be used as shown therein provided that the input signals are already in the form of currents with the appropriate voltage compliance necessary to directly drive the corresponding emitters. However, input signals more typically are in the form of voltages and must be converted to currents before being applied to the circuit of FIG. 1.

One such voltage-to-current conversion means is simply a resistor connected between the input voltage source and the appropriate input terminal of FIG. 1. Although simple, this conversion means exhibits narrow dynamic range, imprecise linearity, and difficult interfacing.

Figure 3:
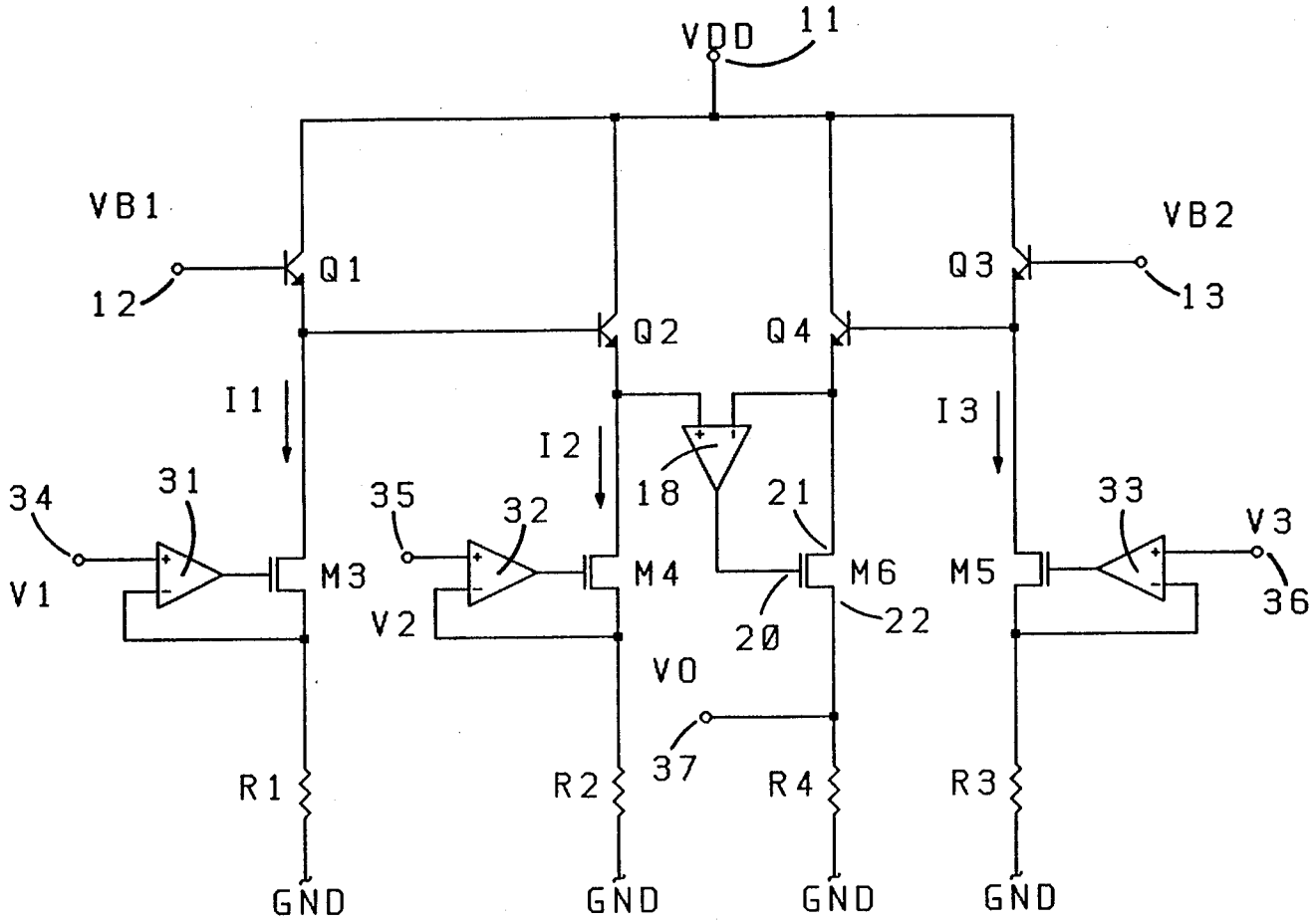
FIG. 3 is a schematic diagram of one high precision embodiment of the present invention where the input and output signals are voltages.

Referring now to FIG. 3 there is shown another embodiment of the present invention capable of accepting input voltages with high precision instead of input currents. Each of the three currents $I_1$, $I_2$, and $I_3$, are generated by precision voltage-to-current conversion means, each comprised of an operational amplifier, pass transistor, and sense resistor. Operational amplifier 31, transistor M3, and resistor R1 convert voltage $V_1$ applied between ground and terminal 34 to current $I_1$; operational amplifier 32, pass transistor M4, and resistor R2 convert voltage $V_2$ applied between ground and terminal 35 to current $I_2$; and operational amplifier 33, transistor M5, and resistor R3 convert voltage $V_3$ applied between ground and terminal 36 to current $I_3$.

The voltage-to-current conversion performed by these conversion means are highly linear according to the following:

$$I_1=V_1/R_1;\ I_2=V_2/R_2;\ I_3=V_3/R_3 \qquad \text{(Equation 7)}$$

The circuit of FIG. 3 further shows yet another possible embodiment of the output transfer means, such transfer means being an N-channel MOS transistor, M6; where the control terminal 20 is the gate, the output current $I_O$ terminal 21 is the drain and the output signal $S_O$ terminal 22 is the source of M6. For such transfer means, output signal $S_O$ is also a current with the same magnitude as output current $I_O$, as is the case for the transfer means shown in FIG. 2, but the direction of $S_O$ is opposite to that of $I_O$.

In the embodiment illustrated in FIG. 3, this output current, $S_O=I_O$, is converted to an output voltage $V_O$, (appearing at output terminal 37,) by resistor R4. The advantage of the transfer means shown in FIG. 3 is that besides simplicity, its linearity and gain of 1 are guaranteed to be nearly perfect.

Finally, the circuit of FIG. 3 demonstrates two possible gain adjustment methods. Unlike the general embodiment of FIG. 1, the base of transistor Q1 and base of transistor Q3 in FIG. 3 are connected to separate bias voltages $V_{B1}$ applied to terminal 12 and $V_{B2}$ applied to terminal 13 respectively. For this arrangement, $V_{BB}$ on the left hand side of Equation 3 becomes $V_{B1}$ and $V_{BB}$ on the right hand side becomes $V_{B2}$. Performing the same mathematical manipulations and substitutions as before, additionally substituting Equation 7 and neglecting transistor mismatches and differential amplifier offset, yields the following final transfer function for the circuit of FIG. 3:

$$V_O=((R_3\times R_4)/(R_1\times R_2))\times e^{(V_{B2}-V_{B1})/V_T}\times(V_1\times V_2)/V_3 \qquad \text{(Equation 8)}$$

The gain factor may therefore be adjusted either by adjusting any of the four resistors R1, R2, R3, or R4; or by adjusting the difference between bias voltages $V_{B1}$ and $V_{B2}$. The former method requires manual adjustment, while the latter method lends itself to automatic adjustment by a microprocessor controlling a DAC.

The simultaneous product and quotient functions provided by the present invention is the general case; as is well known, various arrangements and connections of the input signals allow other functions to be performed as well by a multiplier/divider circuit. For example, making one of the three input signals a fixed reference signal produces an output which is only the product of two inputs, or the ratio of two inputs, depending on which input is fixed. By providing a means which makes the first and second input signals the same, a squaring function is obtained. By setting the third input signal equal to the output signal, an output which is the square root of the product of the first and second input signals is realized. Finally, an output which is the RMS value of an input is generated if a means is provided which makes the first and second input signals equal, if the output is passed through an averaging low pass filter, and if the third input signal is made equal to this averaged output.

Furthermore, simple modifications can be made for obtaining yet other mathematical functions. By inserting the base-emitter electrodes of additional transistors in between the emitter to base connections of the transistor shown in the figures, and applying additional signal currents to the emitters of these added transistors, additional products and quotients can be obtained without any theoretical limitation. Another possible modification is to insert buffers with gains other than unity between the emitter to base connections or between the emitter of Q2 or Q4 and the respective differential amplifier inputs to obtain power and root extraction.

Configuration for RMS value extraction of an input is easily provided by the present invention. For example, in the embodiment of FIG. 3, the input signal $V_i$ to be converted to an RMS value is applied to both terminal 34 and 35. The output $V_O$ from terminal 37 is applied to the input of a low pass averaging filter whose output, $V_O$, is applied to terminal 36. With such a configuration of inputs and outputs, the following transfer function is realized:

$$V_O=K\times V_i^2/V_O \qquad \text{(Equation 9)}$$

Where K is the proportionality factor which includes all factors previously disclosed above. It can be shown that for filter averaging time constants long compared to the period of time varying input signal, $V_i$, Equation 9 is very close to the following:

$$V_O = K \times V_i^2 \quad \text{(Equation 10)}$$

Where the signal $V_O$ is taken from the output of the averaging filter, terminal 36, and is equal to the RMS value of the input $V_i$.

In practice, the embodiment of FIG. 3 configured to perform RMS conversion exhibits somewhat limited dynamic range due to the finite input offset voltages of the various operational amplifiers.

Figure 4:
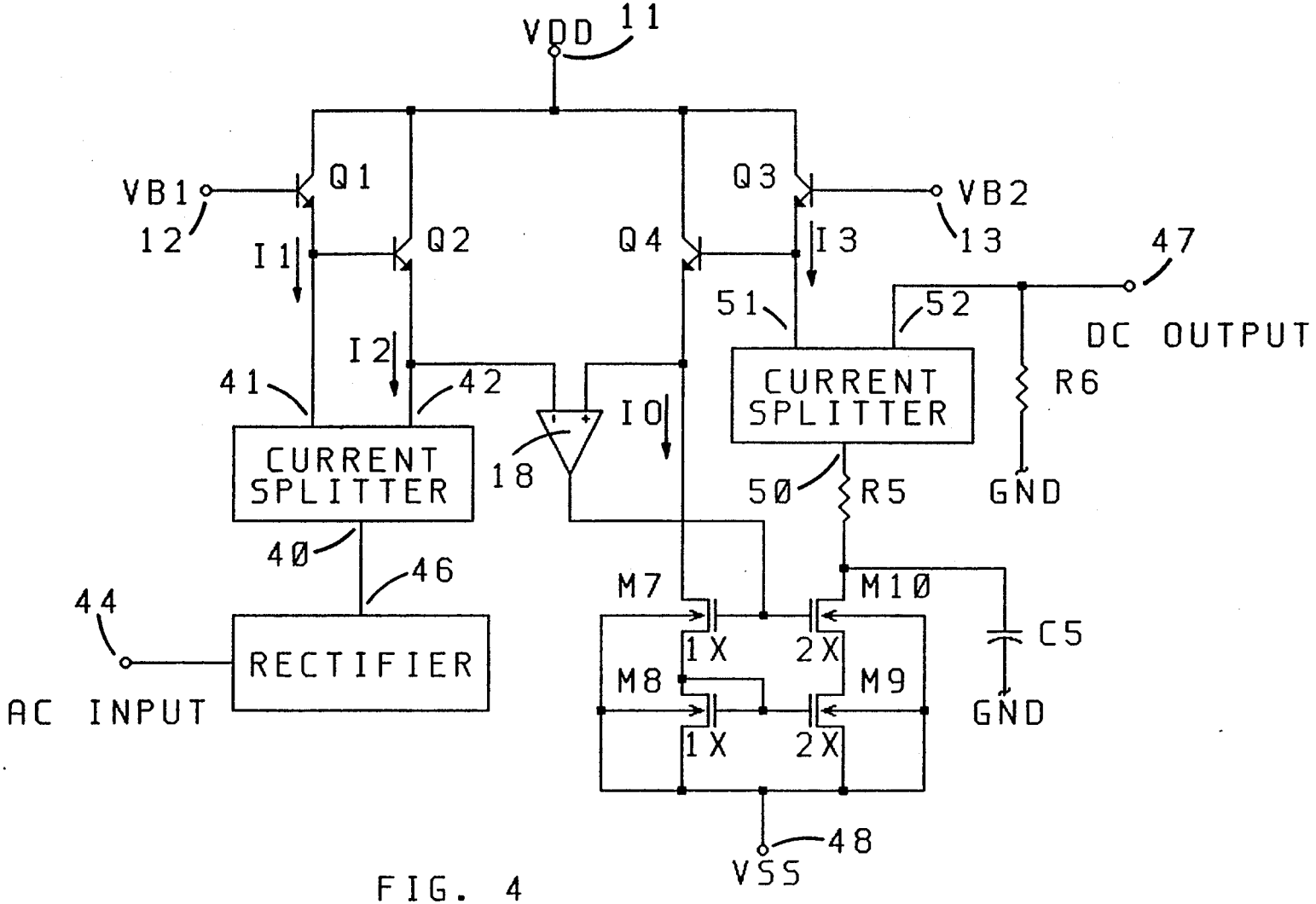
FIG. 4 is a schematic block diagram of a wide dynamic range embodiment of the present invention configured to perform RMS-to-DC conversion.

Referring now to FIG. 4, there is shown a block schematic diagram of an AC RMS-to-DC converter with wide dynamic range incorporating the multiplier/-divider circuit built according to the principles of the present invention. The wide dynamic range is achieved by maintaining all signals in the form of currents except at the initial input and final output. The AC input signal to be converted to DC is applied to terminal 44 and to the input of rectifier 45, typically of the full wave type. The output 46 of rectifier 45 is a full wave rectified current and is applied to input port 40 of current splitter 49. The function of current splitter 49 is to precisely divide any current applied to input 40 into two equal currents, one appearing at output port 41 and the other appearing at output port 42.

Such a current splitter may be implemented with the circuit shown in FIG. 2, where terminals 20, 21, and 22 in FIG. 2 correspond to ports 40, 41 and 42 respectively in FIG. 4. Therefore, $I_1$ equals $I_2$ and both currents are a full wave rectified version of the AC input signal. Transistors Q1 through Q4 and differential amplifier 18 operate the same as in FIG. 1 and FIG. 3. The output of amplifier 18 drives an output transfer means comprised of MOS transistors M7, M8, M9 and M10; where the gates of M7 and M1O are the control port, where the drain of M7 generates the output current $I_O$ applied to the emitter of Q4, and where the drain of M10 generates a transferred output current, the direction of which is the same as $I_O$ but the magnitude of which is twice that of $I_O$ by virtue of the transconductance of M9 being set to twice that of M8.

This transferred output current is applied to a low pass averaging filter comprised of C5 and R5, which results in the current flowing through R5 being an averaged version of the output current $I_O$ but with twice the magnitude. This averaged current is applied to input port 50 of a second current splitter 59, which also may have the same circuit implementation as that of FIG. 2 where terminals 20, 21, and 22 of FIG. 2 correspond to ports 50, 51 and 52 respectively in FIG. 4. Hence, a current flows from port 51 which is an averaged version of current $I_O$ and is applied to the emitter of Q3.

Similarly, an averaged version of current $I_O$ also flows from port 52 and through resistor R6, which converts this current to a voltage appearing at output terminal 47. As the three input signals applied to the multiplier/divider and final output signal meet the same characteristics as those of FIG. 3 when configured to perform the RMS function, the final output voltage at terminal 47 of FIG. 4 therefore is a DC value representing the RMS value of the AC signal input.

Thus, it has been demonstrated that the multiplier/divider built according to the principles of the present invention is easily configured in several ways to perform accurate RMS-to-DC conversion, an important requirement and application for such circuits.

The above disclosure is not intended as limiting. Those skilled in the art will readily observe that numerous modifications and alterations of the circuits may be made while retaining the teachings of the invention. Accordingly, the above disclosure should be construed as limited only by the metes and bounds of the appended claims.

What is claimed is:

1. An analog computational circuit comprising first, second, third, and fourth bipolar transistors;

wherein the emitter of said first transistor is connected to the base of said second transistor; the emitter of said third transistor is connected to the base of said fourth transistor;

and further including a differential amplifier having two inputs and an output; an output transfer means having a control port and at least two output ports, each supplying an output signal which is a function of each of the other said output signals;

and wherein the emitter of said second transistor is connected to one of the inputs of said differential amplifier; the emitter of said fourth transistor is connected to the other of the inputs of said differential amplifier;

and wherein the output of said differential amplifier is connected to the control port of said output transfer means;

and wherein one of the output ports of said output transfer means is connected to either the emitter of said third transistor or the emitter of said fourth transistor wherein the emitter of the first transistor receives a first input, the emitter of the second transistor receives a second input, and the emitter of the third or the fourth transistor receives a third input; and wherein another output port of the output transfer means is the computed output signal.

2. The circuit of claim 1 wherein all bipolar transistors are NPN.

3. The circuit of claim 1 wherein all bipolar transistors are PNP.

4. The circuit of claim 1 wherein said transistors are matched to exhibit substantially the same electrical characteristics, wherein the emitter areas of said transistors are fixed at well defined and stable ratios, and wherein the collectors of said transistors are all connected at a common point to insure a uniform operating temperature.

5. The circuit of claim 1 wherein a buffer having high input impedance and a voltage gain of unity is inserted in line at one or more base/emitter junctions.

6. The circuit of claim 1 wherein each output signal of said output transfer means is directly proportional to any other of said output signals with a high degree of linearity.

7. The circuit of claim 6 wherein said output transfer means is a transistor.

8. The circuit of claim 6 wherein said output transfer means is a circuit which splits a current into two or more component currents.

9. The circuit of claim 6 wherein said output transfer means is a circuit which generates a plurality of currents, the values of which are ratioed to each other by fixed and stable factors.

10. The circuit of claim 1 wherein the emitter current of said first transistor and the emitter current of said second transistor are substantially directly proportional to each other, and where the emitter current of one of said third or fourth transistors is substantially directly proportional to the average value of the emitter current in the other of said third or fourth transistors.

11. An analog computational circuit for generating a computed output signal which is a mathematical function of one or more of three input signals, said circuit comprising in combination:

first, second, third, and fourth transistors, the collectors of said transistors all being connected together in common;

wherein the emitter of said first transistor is connected to the base of said second transistor;

the emitter of said third transistor is connected to the base of said fourth transistor;

and including a differential amplifier having two inputs and an output; and an output transfer means having a control port and at least two output ports, each supplying an output signal which is a function of each other output signal;

and wherein the emitter of said second transistor is connected to one of the inputs of said differential amplifier;

the emitter of said fourth transistor is connected to the other input of said differential amplifier;

the output of said differential amplifier is connected to the control port of said output transfer means;

one of the output ports of said output transfer means is connected to either the emitter of said third transistor or the emitter of said fourth transistor;

and further including means for applying a current which is a function of a first input signal to the emitter of said first transistor;

means for applying a current which is a function of a second input signal to the emitter of said second transistor;

means for applying a current which is a function of a third input signal to the emitter of either said third transistor or said fourth transistor;

means for providing said computed output signal from another of the output ports of said output transfer means.

12. The circuit of claim 11 wherein all bipolar transistors are NPN.

13. The circuit of claim 11 wherein all bipolar transistors are PNP.

14. The circuit of claim 11 wherein said transistors are matched to exhibit substantially the same electrical characteristics, wherein the emitter areas of said transistors are fixed at well defined and stable ratios, and wherein the collectors of said transistors are all connected at a common point to insure a uniform operating temperature.

15. The circuit of claim 11 wherein a buffer having high input impedance and a voltage gain of unity is inserted in line at one or more base/emitter junctions.

16. The circuit of claim 11 wherein one or more of said first, second, or third input signals are fixed reference signals.

17. The circuit of claim 11 wherein each output signal of said output transfer means is directly proportional to each of the other said output signals with a high degree of linearity.

18. The circuit of claim 17 wherein the output transfer means is a transistor.

19. The circuit of claim 17 wherein said output transfer means is a circuit which splits a current into two or more component currents.

20. The circuit of claim 17 wherein said output transfer means is a circuit which generates a plurality of currents, the values of which are ratioed to each other by fixed and stable factors.

21. The circuit of claim 11 wherein one or more of said means for applying said first, second, or third input signals to said emitters is a voltage to current converter.

22. The circuit of claim 11 wherein the computed output signal generated is the root mean square of an input.

23. The circuit of claim 22 wherein said first input signal is directly proportional to said second input signal, and wherein both said third input signal and said computed output signal are directly proportional to the average of the output signal supplied from the output port of said output transfer means which is connected to the emitter of either said third transistor or said fourth transistor.

24. The circuit of claim 23 wherein said average is provided by a low pass filter.

25. The circuit of claim 1 wherein said transistors are parasitic substrate bipolar transistors with the collectors of all the bipolar transistors being connected in common.

26. The circuit of claim 11 wherein said transistors are parasitic substrate bipolar transistors with the collectors of all the bipolar transistors being connected in common.

* * * * *